US005647691A

United States Patent [19]

Wirth

[11] Patent Number: 5,647,691

[45] Date of Patent: Jul. 15, 1997

[54] METHOD AND APPARATUS FOR TRANSFERRING MUD AND SILT

[76] Inventor: John C.J. Wirth, 2837 St. Lucie Blvd., Stuart, Fla. 34997

[21] Appl. No.: 686,086

[22] Filed: Jul. 24, 1996

Related U.S. Application Data

[63] Continuation of Ser. No. 337,847, Nov. 14, 1994, abandoned.

[51] Int. Cl.[6] ..... E02F 3/88

[52] U.S. Cl. ..... 405/74; 37/323; 37/321

[58] Field of Search ..... 405/73, 74; 37/314, 37/317, 320–323

[56] References Cited

U.S. PATENT DOCUMENTS

| | | | |
|---|---|---|---|
| 1,415,113 | 5/1922 | Phillips, Jr. | 37/323 X |
| 1,778,942 | 10/1930 | Harp | 37/323 X |
| 3,301,606 | 1/1967 | Bruno | 37/321 X |
| 3,808,779 | 5/1974 | Randall | 37/322 X |
| 4,322,897 | 4/1982 | Brassfield | 37/323 X |
| 4,409,746 | 10/1983 | Beck | 37/317 |
| 4,681,372 | 7/1987 | McClure | 37/321 X |
| 4,822,106 | 4/1989 | Wilson et al. | 37/314 X |
| 4,854,058 | 8/1989 | Sloan et al. | 37/323 |
| 4,889,391 | 12/1989 | Cornelius | 37/321 X |

FOREIGN PATENT DOCUMENTS

| | | | |
|---|---|---|---|
| 47803 | 3/1982 | European Pat. Off. | 37/323 |
| 909034 | 2/1982 | U.S.S.R. | 37/323 |

*Primary Examiner*—Tamara L. Graysay
*Assistant Examiner*—Frederick L. Lagman
*Attorney, Agent, or Firm*—Malin, Haley, DiMaggio & Crosby, PA

[57] ABSTRACT

A method and apparatus for ecologically safely removing silt, muck, and sand from a waterbottom and for collecting the silt, muck, and sand without destroying the benthos therein into porous containers where the then contained mud and silt can be ecologically positioned where desired to enhance subaquatic environments. The apparatus includes a silt and mud collecting and transfer device that has no moving parts, thereby not endangering the benthos in the transfer process.

7 Claims, 6 Drawing Sheets

METHOD AND APPARATUS FOR TRANSFERRING MUD AND SILT

This application is a continuation of application Ser. No. 08/337,847, filed Nov. 14, 1994, now abandoned.

BACKGROUND OF THE INVENTION

1. Field of the Invention

An apparatus and method for ecologically, safely transferring muck and silt from waterbottoms that includes the transfer of muck and silt, using a portable, submersible, robotic power head that can transfer plants and living creatures, large and small, that live on or in the waterbottom, without damage thereto, and providing porous containers on the waterbottom for receiving the silt or muck, which also allows for a continuing supply of nutrients and food to support sea plants, crustaceans, fish, crabs, and sea animals outside of the porous containers.

2. Description of the Prior Art

Rain and wind-driven organic and inorganic matter produced by animals and plants of all types flows down from mountains, farms, ranches, factories, streets, roads, driveways, roofs, airports, golf courses, septic tanks, horse and cattle ranches, and cemeteries and has, over the years, washed downstream into creeks, streams, rivers, lagoons, and estuaries where it finds its way to the lowest spot along the shore. Every time an aquatic creature, human swimmer, fisherman, or boat of any type, propellers or not, or tide changes, rainstorm, or wind disturbs the water even slightly, the resulting turbulence stirs up the loose muck on the bottom, clouds the water with turbidity, suspends the fines, causing this muck to be carried downstream to foul its benthos, killing millions of creatures otherwise destined for the life creation process many years ahead.

Conventional wisdom of government agencies, quasi-government regulatory agencies, and lobbying groups mandate upland disposition of dredging spoils or muck. Such an approach is like trying to pump septic tank effluent to the top of a hill and waiting for a heavy rainstorm to wash it back down. Upland disposal of muck and silt fails to secure the preservation of the living environment by ordaining the death of an entire benthos by drying and dying in the sun.

Upland disposal is more difficult to accomplish in more densely populated areas and certainly more costly, which drastically cuts down the number of dredging permit applicants to only those who can afford the additional expense. Upland disposal does not help or improve or renew waterbottoms or in any way assist or aid new growth of subaqueous animal and plant life. The present invention will better carry out protection and enhancement of subaqueous ecology while allowing silt and muck to be removed safely and ecologically transferable.

The present invention utilizes in situ containment tubes and bags made of porous synthetic fiber cloth. These tubes allow the transfer of the benthos in the muck to a different location underwater out of harm's way alongside sea plants, mangroves, or seawalls, under a dock or in the form of a subaqueous lagoon or baby fish hatchery or an artificial reef. Each environment provides nutrients and a continuing supply of plant and animal food to support the growth of other forms of life growing by feeding on the outer surface of porous containers.

The present invention also utilizes a muck and silt transfer system that does not destroy living materials in that it does not have any blades or other deleterious transfer devices that would harm the benthos. The system employs a submersible robotic power head which contains no moving parts or cutting edges or vanes to damage living creatures.

SUMMARY OF THE INVENTION

A method and apparatus for transferring siltation and muck from waterbottoms to safely and ecologically transfer benthos without damage thereto, permitting the growth and reproduction of all creatures, large and small, animals, and plants living on or in the waterbottoms by providing silt and muck into porous containers which are ultimately positioned on the waterbottom. The present invention allows for providing a continuous supply of nutrients and food to support the growth on the outside of the porous containers of other sea plants, crustaceans, fish, crabs, and sea animals without the danger of downstream contamination of sea grasses or clam and oyster beds or damage to boat engines, gear drives, and pumps.

The apparatus includes using a portable, submersible power head with no cutting blades, impellers, augers, centrifugal rotor, or other moving parts, which engages siltation and muck and transfers it safely without any damage to large and small animals and plants that live on the bottom.

The present invention utilizes in situ containment tubes and bags made of porous synthetic fiber cloth. These tubes allow the transfer of the benthos in the muck to a location providing more safety underwater, providing both nutrients and a continuing supply of plant and animal food to support the growth of other forms of life by feeding on the outer surface of the porous containers.

A variety of woven, spunweb, and needlepunched fiber cloths are used, depending on engineering considerations, in addition to films, porous films, and membranes to achieve controlled specific gravity of the contents inside the containers.

Several unique types of flotation and inflatables to suspend the containers at water level are used, allowing them to be filled, relocated on the water surface over the underwater location selected, and descend slowly for precise positioning on the waterbottom without rupture of the tubes or their seams.

The silt and muck transfer system utilizes a portable console that includes an electric motor that can be attached to dockside electricity, an air pump driven by the electric motor, a mud and silt collection head, termed a power head, connected to the output of the air source, and optionally, a hydraulic pump. The power head is positioned on the waterbottom and uses air bubbles and exterior lake or ocean water pressure to raise the silt and muck in conjunction with a turbidity shroud, forcing muck and silt through the discharge line into a floating porous container where the silt and other material, living and non-living, is collected. The body of the power head may be heavily weighted, conical, with an inlet chamber and a conduit disposed therethrough that is the discharge conduit for collecting the silt, sand, and muck. Since the power head does not have any moving parts, the system does not hurt any living creatures during muck transfer. The power head may have connected adjacent thereto a plurality of water lines that are connected to the water pump disposed on the pier or dockside so that water jets are strategically aligned around the base of the power head in conjunction with an air supply that is strategically placed in a chamber inside the power head so that the entire action of the water creates a vortex and turbulence at the mouth of the discharge tube in the power head in conjunction with air bubbles to move silt, sand, and muck into the discharge line where the air bubbles and muck rise to the surface for collection in a floating porous container.

Once the floating container is filled with the muck and silt or sand, the container can be placed on the waterbottom at a desired location where the container prevents further silt from being disturbed, to line the waterbottom to prevent continued turbulence and collection of silt and muck on the bottom.

Using the present invention allows for continuous inlet maintenance, beach renourishment, structural reefs for enhancing aquatic growth, and for clearing channels without resorting to upstream relocation. A channel bottom can be lined with containers filled with silt and muck to enhance aquatic growth while at the same time reducing turbulence.

It is an object of this invention to provide an ecologically safe system for transferring silt and muck from waterbottoms.

It is another object of this invention to provide an apparatus that can safely transfer silt and muck from a waterbottom without damaging any living creatures on the bottom.

And yet still another object of this invention is to provide an improved ecologically safe system for removing silt and muck and to get rid of turbidity along a waterbottom in which the silt and muck can be collected in containers which are placed on the waterbottom for enhancing aquatic growth around them.

In accordance with these and other objects which will become apparent hereinafter, the instant invention will now be described with particular reference to the accompanying drawings.

DESCRIPTION OF THE PREFERRED EMBODIMENTS

The success of the present invention system and process for the non-destructive transfer of benthos is attributable to the efficient, economic performance of the invention of a submersible robotic power head which contains no moving parts or cutting edges or vanes to damage the benthos.

Figure 1:
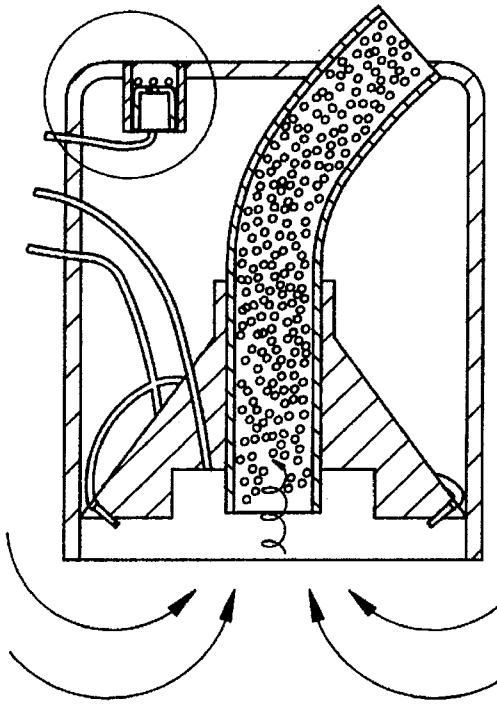
FIG. 1 shows a side elevational view, partially in cross section of the power head used in the present invention.

FIG. 1 illustrates the simplicity of the power head, the proper performance of which is based on the number and diameter of its air jets in relation to the outside circumference of the inlet nozzle and the spacing between the bottom of the inlet nozzle and the turbidity shroud. The diameter of the turbidity shroud in relation to the inlet nozzle is also important to the ability of the power head to maintain adequate negative pressure to contain turbidity.

In operation, air supplied to the air chamber bleeds through the air jets, creating a negative pressure differential inducing a rapid flow of water transferring muck and benthos up the discharge tube into a containment tube which, when filled, is floated to its predesignated position and lowered to the waterbottom.

The choice of type and power of the air supply, the diameter of the discharge tube, and the depth of the turbidity shroud determine the rate of solids transfer.

Figure 2:
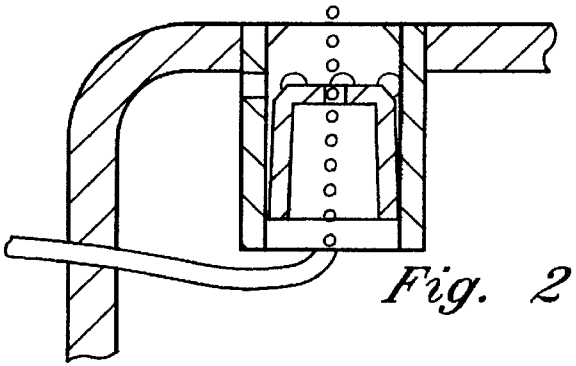
FIG. 2 shows a side elevational view, partially in cross section, of the leaking inverted cup valve used in the power head shown in FIG. 1.

FIG. 2 illustrates the "leaking inverted cup valve" for raising and lowering the power head. Bleeding air into the inverted cup causes it to rise. Its top is designed as a valve which, when seated, closes off the air chamber which fills with air, causing the power head to rise. Cutting off the air supply to the inverted cup results in continued leaking of air through the dimensioned opening at the top of the cup which quickly allows it to drop, admit water to the air chamber and lower the shroud to the bottom (generally to a different location each time because of the torque of the connecting hose lines).

Figure 3:
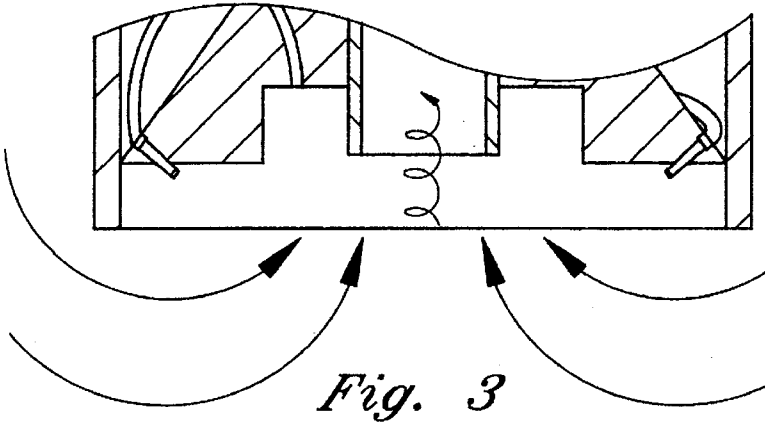
FIG. 3 shows a cutaway view of a power head diagrammatic drawing for power direction and control with the present invention.
Figure 4:
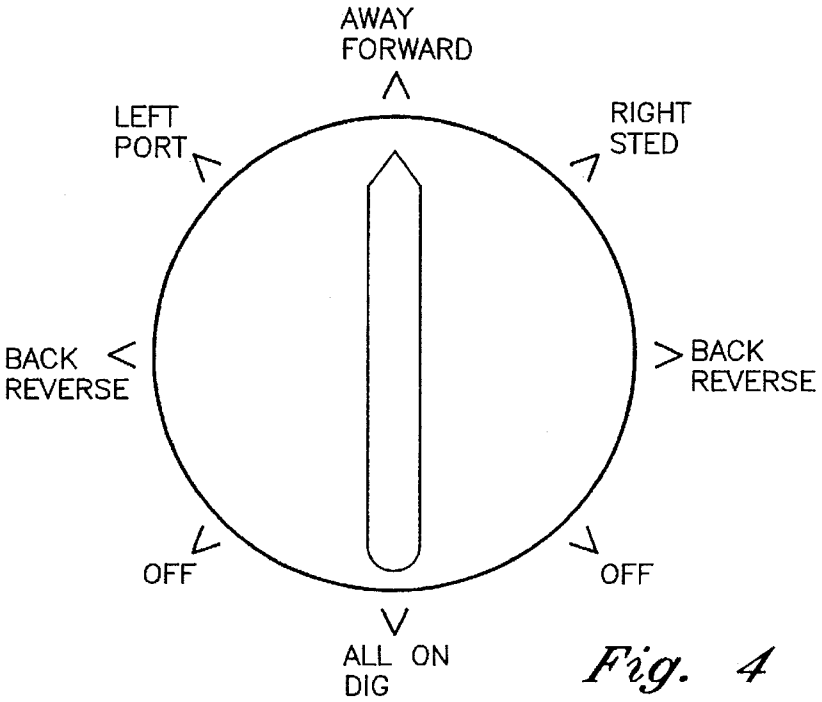
FIG. 4 shows a control valve used in the present invention.

FIG. 3 discloses the directional control using four water jets sourced by a water pump on the control console. These water jets face about 30 degrees toward the center and 5 degrees down. The horizontal force component of the jets make the power head move smartly in the desired direction using the invention of a directional control valve, FIG. 4. For example, closing off three jets will cause the power head to "swim" in the direction opposite to the fourth jet. For simplicity, this valve allows single jet powered operation in four directions, with two jets contributing to direction control for each 90 degree quadrant. Two positions are provided for BACK or REVERSE to obviate the need to turn the valve 180 degrees. Two positions are also provided for the OFF position which diverts the water away from the four jets, as desired.

When the power head is on the waterbottom and the directional valve is in the ALL ON, DIG position, the four water jets create a vortex in the direction of the coriolis force, which increases solids throughput and prevents turbidity by drawing fine solids into a column below the inlet nozzle, and above the main silt column being forced up the discharge tube (by the pressure differential caused by the expanding air bubbles in the discharge tube).

Figure 5:
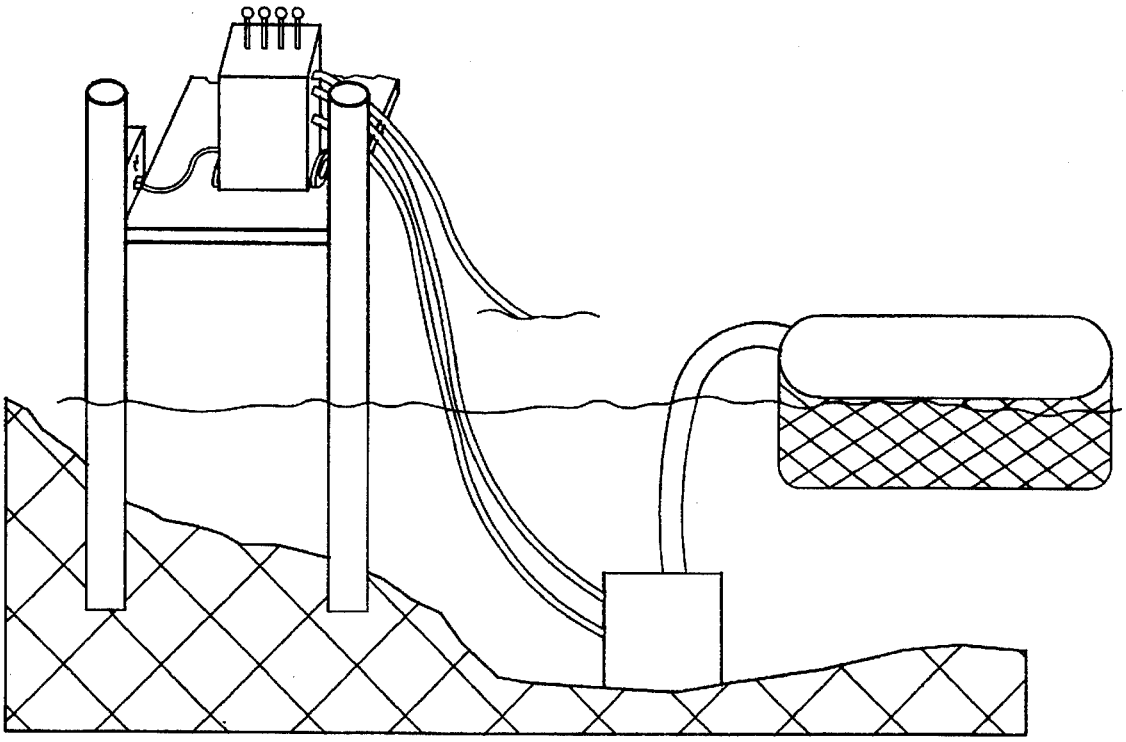
FIG. 5 shows a side elevational view in cross section of the submersible system in accordance with the present invention.
Figure 10:
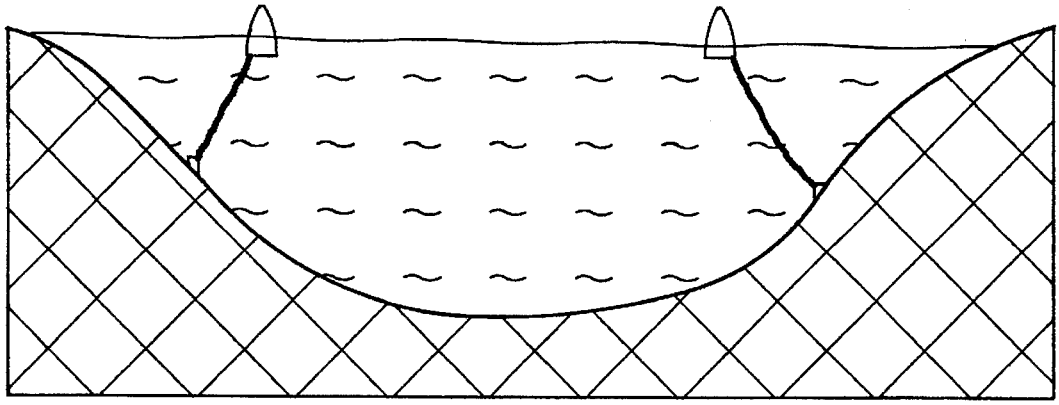
FIG. 10 shows a side elevational view of the present invention as used in a channel.
Figure 5A:
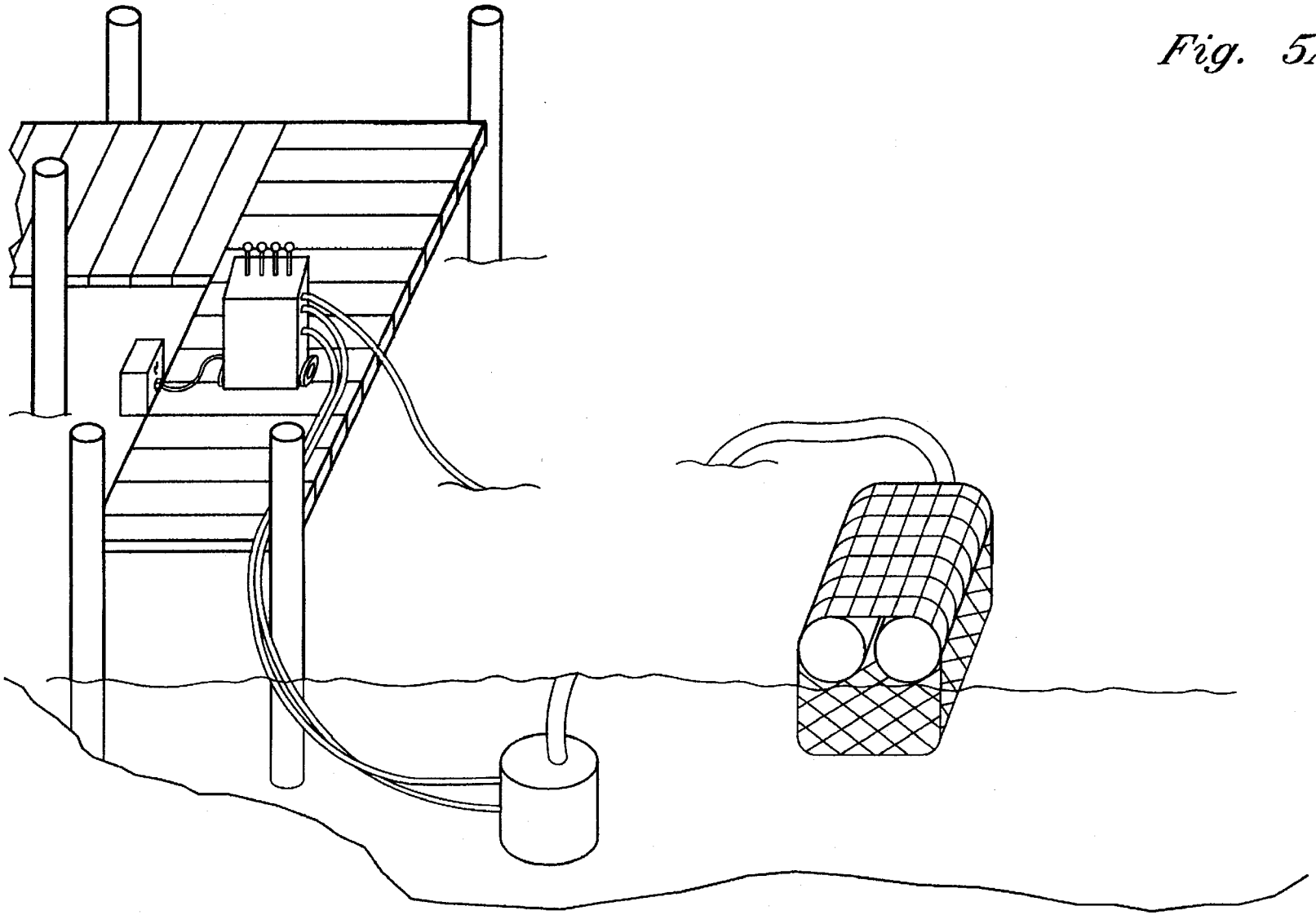
FIG. 5A shows a side elevational view, partially in perspective, of the operation of the present invention.

FIGS. 5 and 5A show the interaction of the control console, dockside power water intake, tethered air and water line, power head with turbidity shroud, flotation and "Smartube."

Figure 6:
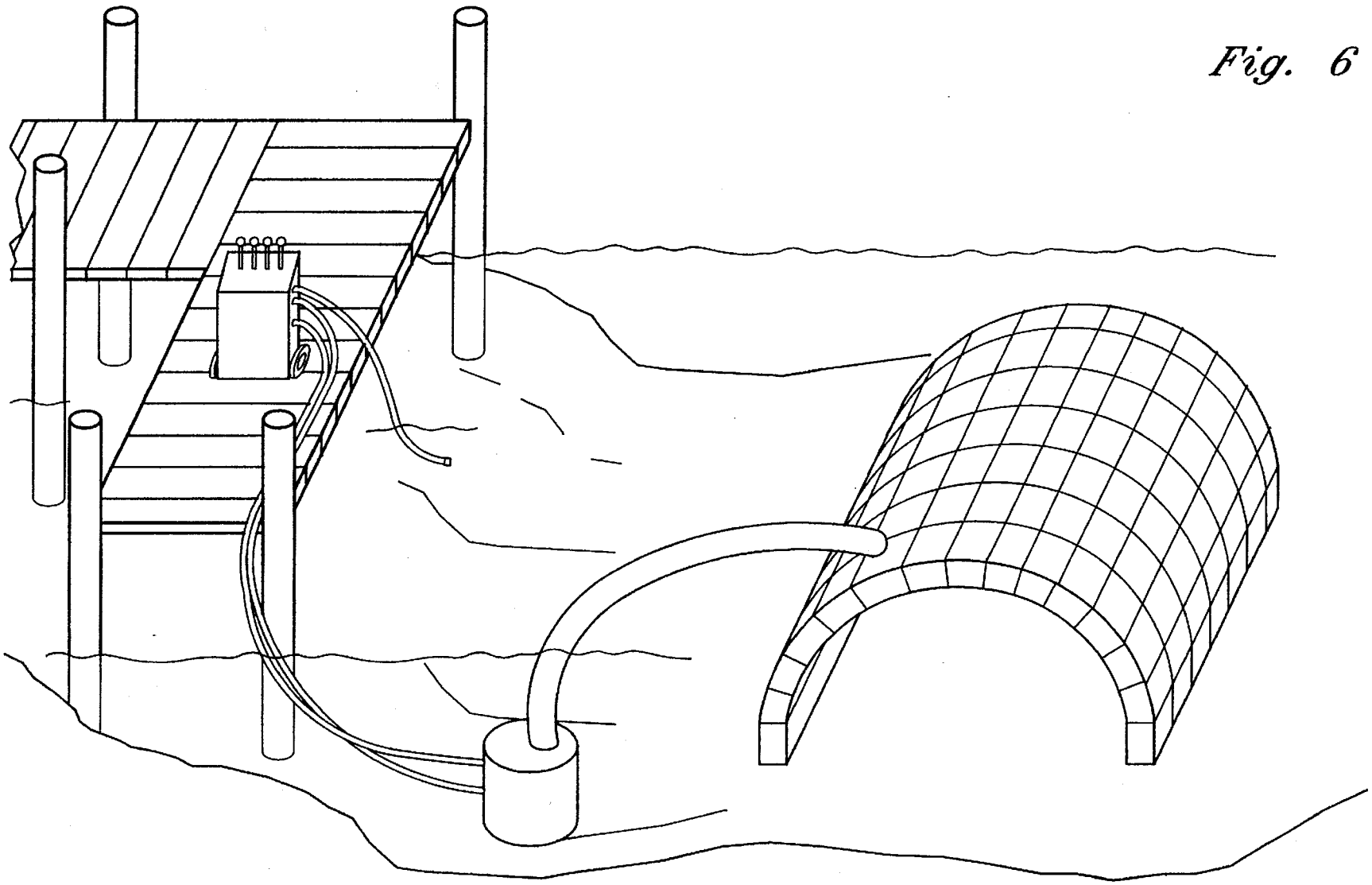
FIG. 6 shows a perspective view of a reef that can be made with the present invention.

FIG. 6 illustrates the use of this system for filing structural artificial reef tubes on the ocean floor, with some at substantial depths. Note that "reefers" may be filled inshore with muck and benthos, thereby enhancing their usefulness in accelerating the growth of plant and animal life on the artificial reef. Alternatively, "reefers" may be also filled and compacted with sand from the ocean floor.

"Coral Reefers" can incorporate fine copper wires in their construction for the low voltage electrolytic deposition of calcium carbonate on the surface of the reef tubes. This can also be accomplished by using metal powder filled fibers or metallized fibers.

It must be noted that artificial reefs are generally installed at depths greater than allowed for navigation channels and are designed and equipped differently to meet the special requirements of the greater depths.

Figure 7:
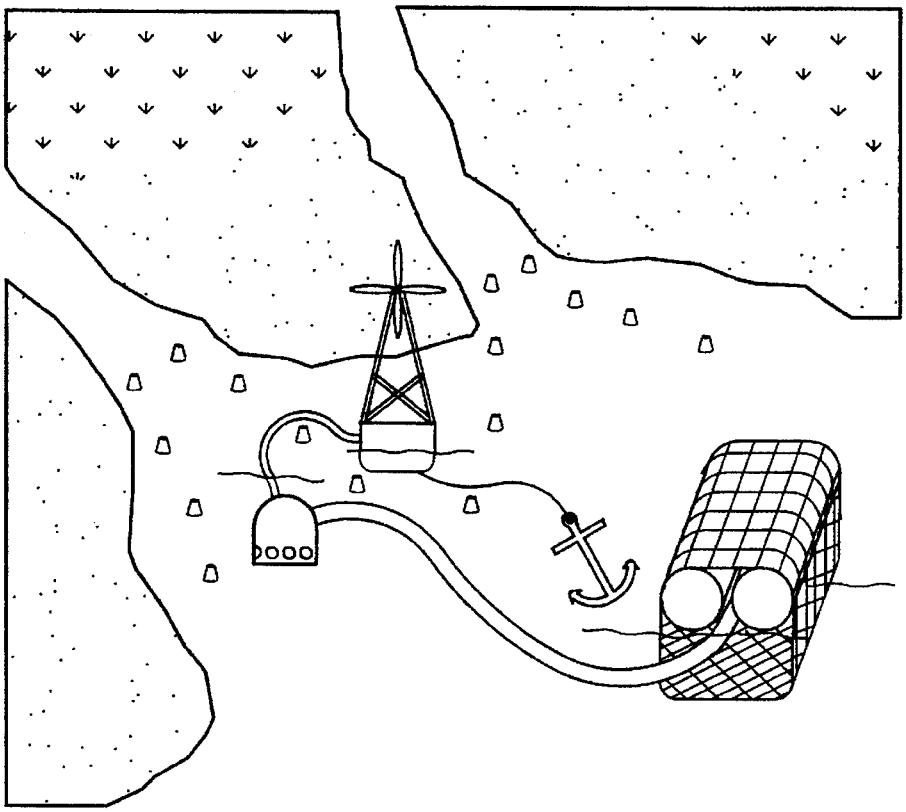
FIG. 7 shows a top view of continuous maintenance using the present invention.

FIG. 7 shows the system adapted for use in inlet maintenance using windpower as an alternative power source and semi-permanent but relocatable channel markers/sand collection stations. The system will operate continuously 24 hours daily whenever the power supply permits. As my "Smartubes" are filled, they are replaced and floated elsewhere depending on the market value of the contents.

Figure 8:
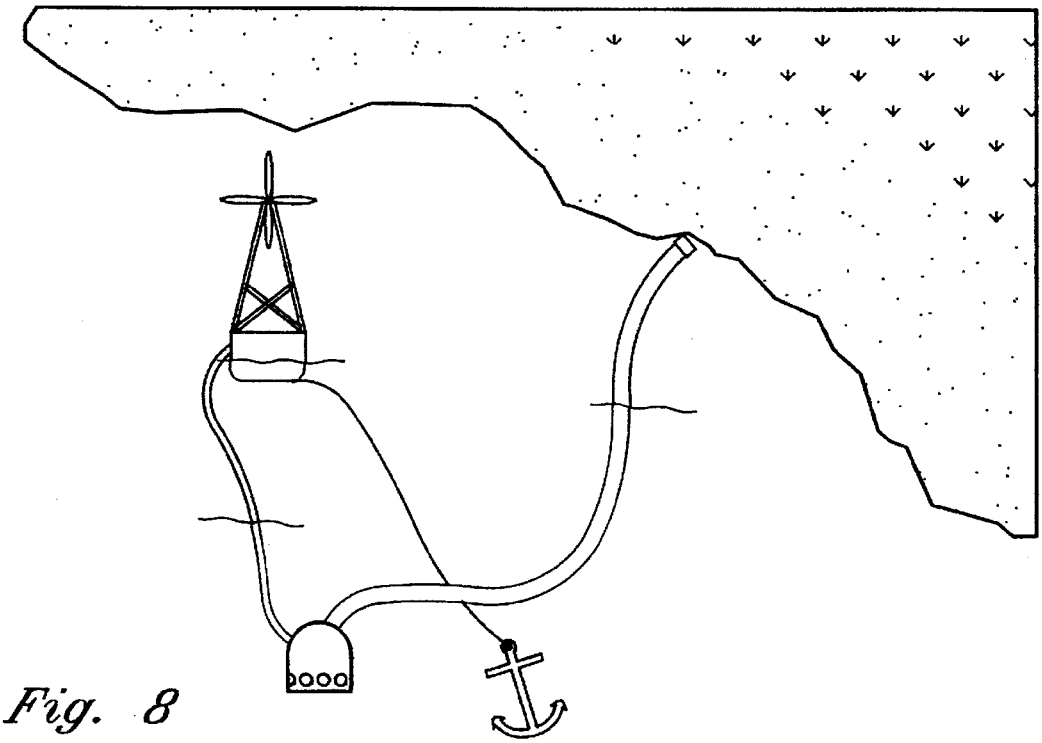
FIG. 8 shows a side elevational view of the operation of the present invention using a wind generator supply.
Figures 9A, 9B, 9C, 9D:
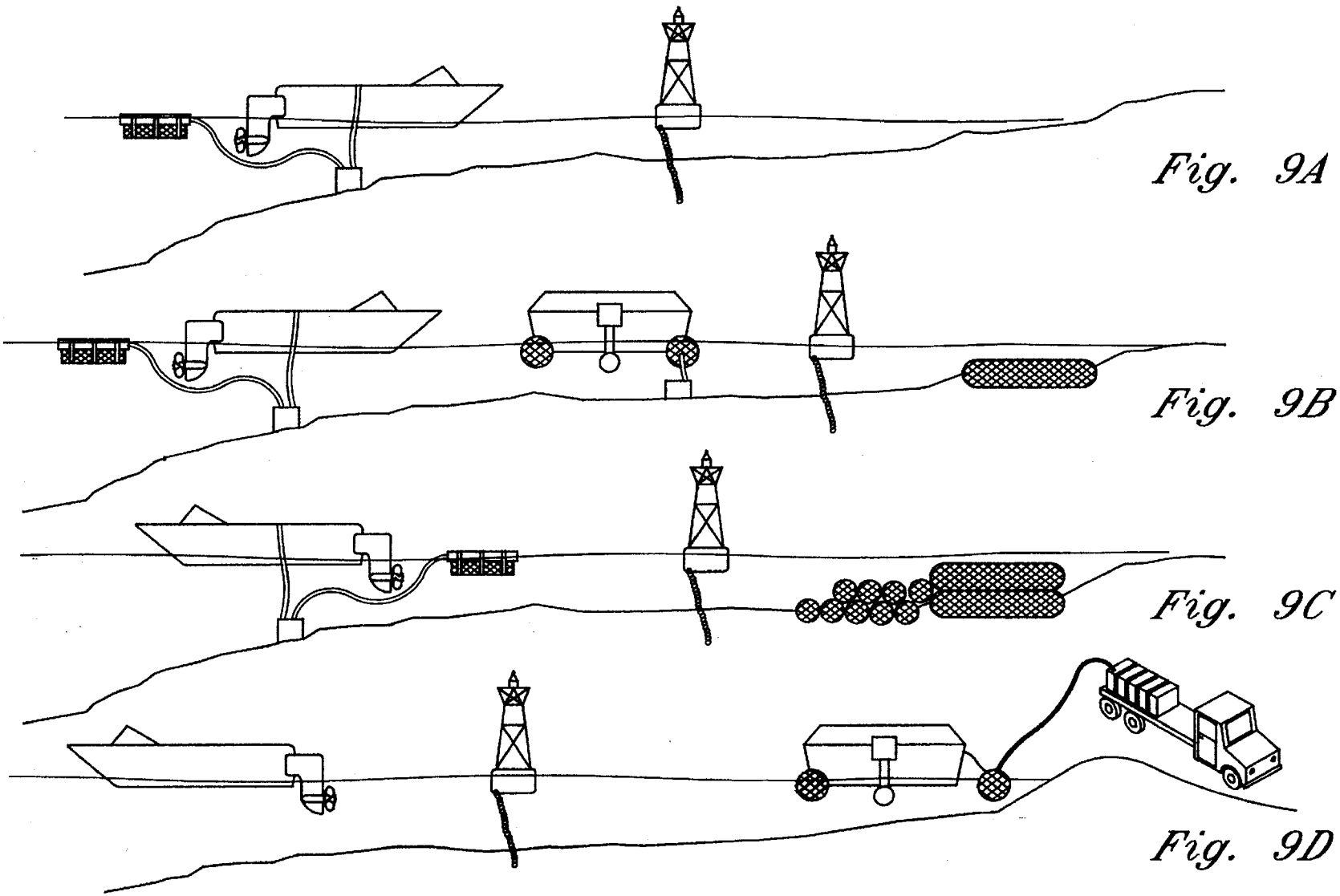
FIGS. 9A–9D shows a sequential schematic side elevational view of the operation for shoal operations.

FIG. 8 shows the system in use for both continuous beach renourishment as well as filling energy absorbing "Geltubes," used for upland capture of ocean sand for beach renourishment.

FIGS. 9A–9D shows my adaptation of my sand transfer invention as a "Shoalsucker" for emergency channel maintenance patrols by pontoon boats and small outboard and inboard sea craft used by the Coast Guard, Coast Guard Auxiliary, and specially authorized safety patrols.

The use of these units requires on board power of 30 amps at 230 volts (a small portable generator).

The sand transfer heads are normally locked and sealed in the UP or horizontal position and are lowered only in a shoaling emergency and at forward speeds less than 3 mph. Vanes on the power head will cause it to tilt off the bottom at high speed or if an obstruction is encountered. The "Shoaltubes" have limited capacity of two yards each but include flotation and marker buoys for off-channel stowage when filled. Tow lines are included for quick use when needed to transfer life threatening shoaling in navigation channels and dangerous inlets. Smaller and larger "Shoaltubes" will be available for professional use.

There are many other uses for the sand transfer system, each of which may require special mechanical adaption for use in aquaculture, collecting golf balls, industrial sludge, cleaning the bottoms of storage tanks, cleaning underground conduits, and so on.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A method for ecologically safely transferring sand, muck, and silt from a waterbottom into filtered containers for disposition on the waterbottom, comprising the steps of:

(a) positioning a body having no moving parts adjacent a waterbottom containing muck, silt, and benthos;

(b) inducing air into a muck and silt removing head;

(c) providing a discharge line from said muck and silt removing head to a surface of a body of water;

(d) collecting the silt, muck, and benthos from the waterbottom in a filtered container floating on the surface of the body of water, whereby the benthos residing in the silt and mud can be safely transferred from the waterbottom to the porous container;

(e) transferring the container filled with muck, silt, and benthos to a desired location.

2. A method for ecologically safely transferring sand, muck, and silt from a waterbottom into filtered containers for disposition on the waterbottom, comprising the steps of:

(a) positioning a body having no moving parts adjacent a waterbottom containing muck, silt, and benthos;

(b) inducing air into a muck and silt removing head;

(c) providing a discharge line from said muck and silt removing head to a surface of a body of water;

(d) collecting the silt, muck, and benthos from the waterbottom in a porous container floatinq on the surface of the body of water, whereby the benthos residing in the silt and mud can be safely transferred from the waterbottom to the filtered container;

(e) transferring the container filled with muck and silt to a desired waterbottom location for enhancing aquatic activity around the container filled with muck and silt and to prevent additional turbulence and silt from accumulating on the waterbottom.

3. An apparatus for removing mud and silt ecologically safely from a waterbottom without destroying benthos contained therein, comprising:

a source of air under pressure;

a weighted body having a large aperture disposed therethrough and a suction chamber therein;

a discharge conduit having a first end and second end, said discharge conduit first end connected to the aperture of said weighted body and connected in fluid communication with the suction chamber therein;

an air supply conduit having a first end and second end, said air supply conduit connected at said first end to said source of air under pressure and at said second end, to the suction chamber in said weighted body, said air conduit second end including a means for generating bubbles;

a filtered container connected to the second end of said discharge conduit, whereby mud and silt can be removed by directing air under pressure into said suction chamber where it forms bubbles which rise up through the discharge conduit;

a source of water under pressure;

a water conduit having a first end and a second end, said water conduit first end connected to said source of water under pressure, and said second end connected, in fluid communication, to a plurality of water jet nozzles connected to said weighted body; and means for controlling each of said plurality of water jets, connected between said first end and said second end of said water conduit, wherein said weighted body moves in a predetermined direction responsive to activated water jet nozzles.

4. An apparatus as in claim 3, including:

an enclosure surrounding said weighted body to reduce turbidity surrounding said weighted body, said enclosure including means for controlling vertical movement of said weighted body.

5. An apparatus as in claim 4, wherein said means for controlling vertical movement is a leaking inverted cup valve, said valve having an air chamber with means for controlling inlet air located remotely from said enclosure.

6. An apparatus as in claim 3, wherein said plurality of water jet nozzles equals four, said water jet nozzles positioned symmetrically around said weighted body.

7. An apparatus as in claim 3, wherein said means for controlling includes a control valve, remote from said weighted body, said control valve controlling the flow of said water under pressure to each of said plurality of water jet nozzles, said water jet nozzles positioned wherein said weighted body moves in a horizontal direction toward an activated water jet nozzle, or activated water jet nozzles.

* * * * *